United States Patent [19]

Lin

[11] Patent Number: 4,842,491

[45] Date of Patent: Jun. 27, 1989

[54] APPARATUS AND METHOD OF DETERMINING COMPRESSOR STRUCTURAL RESONANT FREQUENCY

[75] Inventor: Chih M. Lin, Tyler, Tex.

[73] Assignee: American Standard Inc., New York, N.Y.

[21] Appl. No.: 155,431

[22] Filed: Feb. 12, 1988

[51] Int. Cl.[4] ..... F04B 21/00

[52] U.S. Cl. ..... 417/312; 181/403

[58] Field of Search ..... 417/312, 313, 363, 902; 181/169, 170, 403; 62/296

[56] References Cited

U.S. PATENT DOCUMENTS

| | | | |
|---|---|---|---|
| 2,721,028 | 10/1955 | Dills | 417/902 X |
| 2,721,029 | 10/1955 | Grimshaw | 417/902 X |
| 3,187,995 | 6/1965 | Kjeldsen . | |
| 4,345,882 | 8/1982 | Saito et al. | 417/312 |
| 4,370,104 | 6/1983 | Nelson et al. | 417/902 X |

*Primary Examiner*—Leonard E. Smith

*Attorney, Agent, or Firm*—William J. Beres; David L. Polsley; Robert J. Harter

[57] ABSTRACT

Apparatus and method for selectively determining the resonant frequency of a gas compressor including a compressor drive motor and a muffler in a generally spaced relationship, and an apparatus mechanically linking the compressor drive motor and the muffler. The apparatus as disclosed in one embodiment includes two conical frustums as wedge members, each having an axial bore accommodating a single non-resilient shaft for joining the conical frustums such that the shaft may be adjusted to force the wedge members closer together, biasing the muffler with respect to the compressor drive motor, and thereby adjusting the resonant frequency of the compressor structure to a determined resonant frequency.

23 Claims, 2 Drawing Sheets

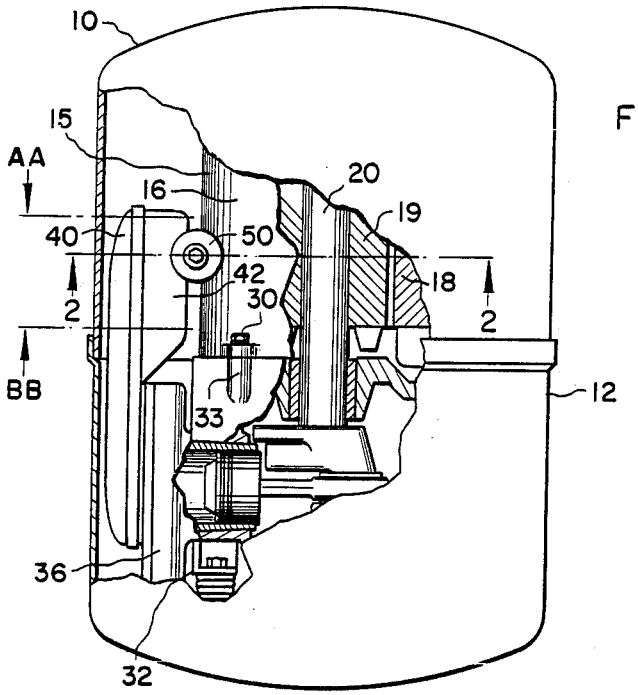
FIG. 1
FIG. 2
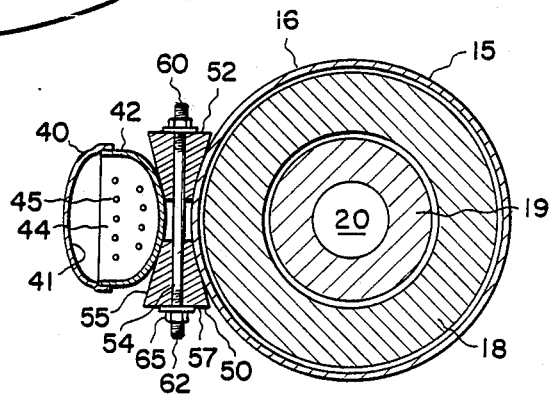
FIG. 3
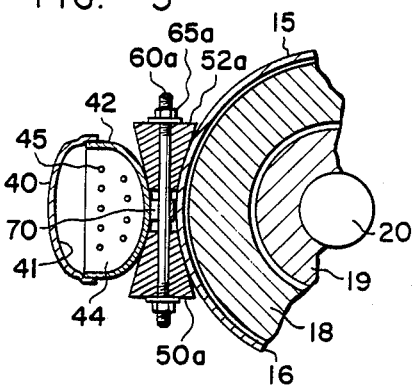
FIG. 4
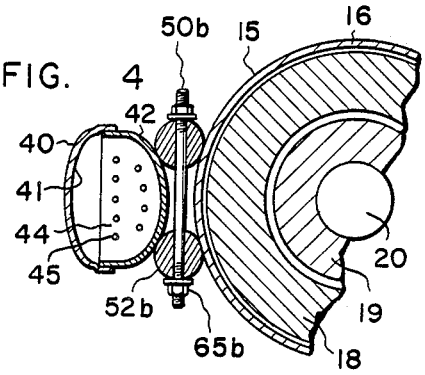
FIG. 5
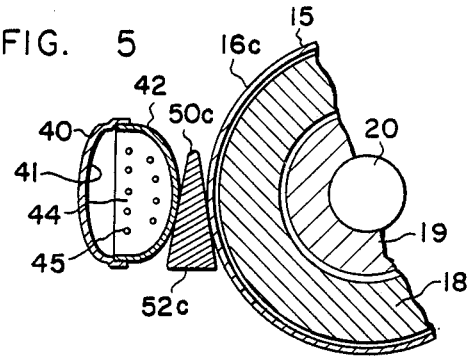

FIG. 6
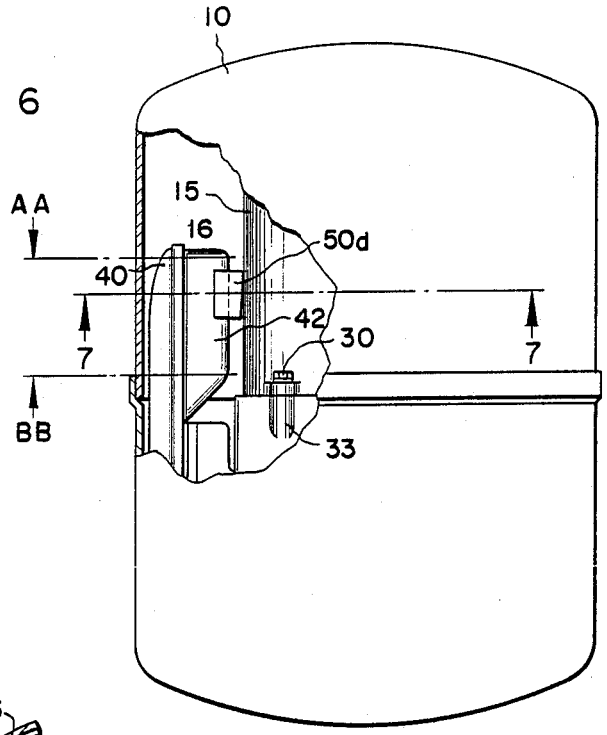
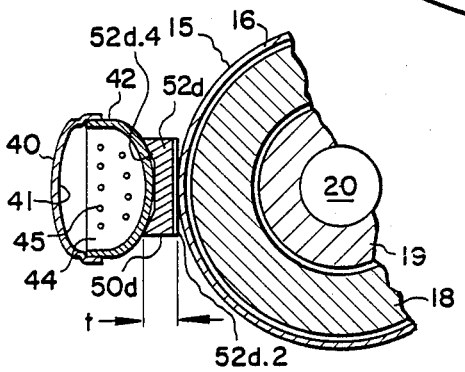
FIG. 7
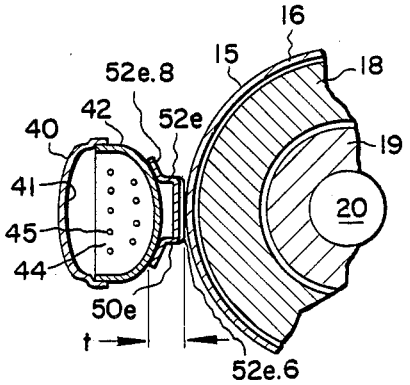
FIG. 8

APPARATUS AND METHOD OF DETERMINING COMPRESSOR STRUCTURAL RESONANT FREQUENCY

TECHNICAL FIELD

This invention generally pertains to means for controlling noise in gas compressors and specifically to a means for adjustably wedging between a muffler and compressor drive in a gas compressor to bias the muffler with respect to the compressor drive motor and thereby selectively determine the structural resonant frequency of the compressor.

BACKGROUND ART

It is typical for an operating gas compressor to develop a resonant frequency in its structure. This resonant frequency is determined by a great number of factors, including the design of the gas compressor, stiffness of the gas compressor structure, structural materials, operating speed and so forth. It has also been found that there are frequencies and ranges of frequencies which are perceived as more and less loud by the human ear. Therefore, it is desirable to control the resonant frequency of a gas compressor, so as to limit the perceived noise of the gas compressor. Typically this is achieved by selection of structural materials and designs which provide suitable structural strength and the desired gas compressor performance while incidentally lowering the perceived noise. The perceived noise is then typically further reduced by the addition of mufflers and sound deadening materials to the gas compressor. However, in order to obtain a cost effective design of the gas compressor, it is not feasible to bring this perceived noise as low as desirable.

In consideration of the foregoing, it is an object of this invention to provide an apparatus and a method of altering the structural resonant frequency of a gas compressor in a cost effective manner.

It is a further object to provide for altering the structural resonant frequency of a gas compressor to a determined resonant frequency to produce a lowered perceived noise of the gas compressor.

Another object is to provide for altering the structural resonant frequency of the gas compressor without requiring structure of substantially increased stiffness and weight.

These and other objects of the invention will be apparent from the attached drawings and the description of the preferred embodiment that follows hereinbelow.

SUMMARY OF THE INVENTION

The subject invention is a wedge disposed between a compressor drive motor and a compressor muffler in a gas compressor for mechanically linking between the drive and the muffler. The wedge is adjustable to bias the muffler with respect to the drive so as to determine or fix the structural resonant frequency of the gas compressor. In the preferred embodiment, the invention consists of a plurality of conical frustums having axial bores. An inflexible shaft, which may be of steel, extends through the axial bores and between the conical frustums, with the frustums mounted at each distal end. The inflexible shaft includes means for forcing each of the frustums toward the other. The frustum and shaft assembly is disposed between the drive and the mufflers at a selected vertial location and the frustums are forced together to bias the muffler with respect to the drive means thereby determining the resonant frequency of the structure of the gas compressor.

BRIEF DESCRIPTION OF THE DRAWINGS

FIG. 1 shows a cutaway view of a compressor system including a wedge.

FIG. 2 is a view of the preferred embodiment shown in a partial cross-sectional view of the compressor along section line 2—2 of FIG. 1.

FIG. 3 is a view of an alternative embodiment shown in a partial cross-sectional view of the compressor taken along section line 2—2 of FIG. 1.

FIG. 4 is yet another view of an alternative embodiment shown in a partial cross-sectional view of the compressor system taken along section lines 2—2 of FIG. 1.

FIG. 5 is a view of an alternative embodiment of the wedge shown in a partial cross-sectional view of the compressor system taken along section lines 2—2 of FIG. 1.

FIG. 6 shows a cutaway view of the compressor system including an alternative embodiment of the wedge.

FIG. 7 is a partial cross-sectional view, taken through line 7—7 of FIG. 6, of the alternative embodiment of the wedge and the compressor.

FIG. 8 is a partial cross-sectional view, taken through line 7—7 of FIG. 6, of another alternative embodiment of the wedge and the compressor.

DESCRIPTION OF THE PREFERRED EMBODIMENT

A compressor system generally denoted by reference numeral 10 as shown in FIG. 1. Compressor system 10 is a reciprocating compressor, housed in a hermetic shell 12. The actual compressor portion of compressor system 10 is depicted only generally in FIG. 1 since details regarding the compressor are considered to be generally well understood and need not be described to promote understanding of the form and function of the subject invention; however, in an actual application of the preferred embodiment of the invention, a single-cylinder reciprocating type refrigeration compressor is used. A scroll compressor or other a rotary compressor would be equally suitable.

Referring generally to FIGS. 1 through 8, compressor system 10 is driven by a drive means such as an internal electric motor 15 which has an exterior 16 housing a stator 18 and rotor 19. A compressor drive shaft 20 passes through rotor 19, and its distal end connects to the compressor which is generally denoted by reference numeral 30. The motor exterior 16 is secured to the compressor housing 32 by a number of bolts 33, disposed at spaced intervals around the periphery of the motor exterior 16 so as to completely enclose motor 15 to the compressor housing 32.

The compressor 30 includes a compressor discharge valve housing 36 through which compressed refrigerant is discharged from the compressor 30. The details of the compressor discharge valve are not shown as various types of discharge valve assemblies are well known in the art and are not necessary to understanding the form and function of the subject invention. In the preferred embodiment, however, a biased annular ring type valve is used, although other types of valves would also be suitable.

A discharge muffler 40 extends from the discharge valve housing 36 in a direction substantially parallel to and removed a certain, generally spaced distance from the motor exterior 16. The discharge muffler 40 includes therein an interior portion 41 and an exterior portion 42. A baffle plate 44 with a number of apertures 45 therethrough extends perpendicularly across the interior portion 41 to inhibit and muffle the refrigerant flow from the discharge valve of the compressor 30. The discharge muffler 40 includes a distal end with a discharge aperture 46 therein. It is to be understood that other forms of muffling elements within the discharge muffler 40 would be equally satisfactory. In operation, the motor 20 drives the compressor system 10, causing the compression of refrigerant gas flowing through the compressor system 10. This flow of gas and movement of components generates a structural resonant frequency in the compressor system 10, a summation of all the resonant frequencies developed by the individual components such as the motor 15 and the muffler 40. A wedge assembly 50 is shown disposed in mechanical linkage between the muffler exterior 42 and the motor exterior 16 so as to bias the muffler with respect to the motor and thereby selectively determine or fix the resonant frequency of the motor 15 and the muffler 42 and in turn compressor system assembly 10.

Turning now to FIG. 2, the wedge assembly 50 is shown in greater detail. The preferred embodiment includes the use of two wedge members 52. Each wedge member 52 has an aperture therethrough defined by an axial bore 54. Each wedge member 52 is further comprised of two generally parallel planar surfaces with a wedging surface 55 in the shape of the frustum of a cone, also identified as a conical frustum, generated about an axis extending therebetween. In the preferred embodiment, the axis of the conical frustum is perpendicular to the planar surfaces, but the axis need not be so directed. At the junctures of the conical frustum and the planar surfaces, a corner of a relatively small radius extending about the wedging surface 55 may be included in alternative embodiments to facilitate ease of handling and assembly of the wedge assembly 50. Wedging surface 55 of wedge member 52 engages simultaneously the muffler 40 and the motor exterior 16 in at least point contact. Each wedge member 52 also includes a wedge securing surface 57 defined by the larger planar surface which is the base of the frustum. An inflexible wedge securing member 60, adapted to pass through the axial bore 54 of each wedge member 52 includes threaded portions 62 at each distal end thereof. Alternatively, securing member 60 may be threaded its entire length. Nuts 65 with mating threads of the threaded portion 62 operate to secure two wedge members 52 upon a securing member 60 to complete a wedge assembly 50.

The wedge assembly 50 is located between the points identified as AA and BB in FIGS. 1 and 6. For convenience, this location is referred to herein as the selected or vertical location. This vertical location will vary between types of compressor systems 10 in which the wedge assembly 50 is employed, generally being that location providing optimal determination of the structural resonant frequency, as the vertical location directly affects the amount of frequency shift for a compressor system 10. The preferred vertical location is that at which the muffler 40 and the motor 15 develop individual resonant frequency components most out of phase with respect to each other, as found by testing of the compressor system 10.

In operation, a wedge assembly 50 is prepared with a securing member 60 passing through the axial bores 54 of two wedge members 52. The wedge members 52 are disposed upon the securing member 60 with the wedge securing surface 57 of each respective wedge member 52 presented to a distal end of the securing member 60. A nut 65 is placed in threading engagement with each distal end of securing member 60 and placed in surface contact with a wedge securing surface 57. The smaller end of each frustum is thereby directed centrally on the wedge assembly 50. The wedge assembly 50 is then placed between motor exterior 16 and muffler exterior 42 at the selected vertical location such that each wedge member 52 is in simultaneous point contact with and mechanically links the muffler exterior 42 and motor exterior 16. Tension is then applied to securing member 60 by turning the nuts 65 to cause them to advance toward the center of securing member 60. This advancement of nuts 65 forces each wedge member 52 toward the center of the securing member 60 thereby bringing a larger diameter portion of the frustum of the wedging surface 55 into contact with the muffler exterior 42 and the motor exterior 16. As the diameter is increased, the muffler 40 is physically biased away from the motor 15 and away from the position which it would occupy absent the wedge assembly 50. The wedge assembly 50, when thus tensioned, therefore creates a preload condition between the motor 15 and the muffler 40 effective to increase the structural resonant frequency of the compressor system 10. The resonant frequency of the compressor system assembly 10 can therefore be adjusted to a selected determined value by appropriately locating the wedge assembly 50 and varying the preload between the muffler 40 and the motor 15 created by the tension applied to securing member 60 by nuts 65.

A first alternative embodiment is shown in FIG. 3. This embodiment includes the wedge assembly **50*a* substantially as described in the preceding paragraphs, with the addition of a wedge assembly mounting bracket 70 to retain the assembly 50*a* between the motor and the muffler at the selected location. The bracket 70 as shown in FIG. 3 preferably is a piece of steel securely welded to muffler exterior 42, but may be of other material or otherwise secured or located. The bracket 70 includes an aperture 72 for retaining the central portion of securing member 60*a*. This embodiment provides for a greater ease of assembly, in that the securing member 60*a* is placed with the central portion thereof in bracket 70 and the wedge members 52*a* are then located upon the securing member 60*a* and the nuts 65*a* threaded on to the distal ends of securing member 60*a*. This embodiment is substantially the same in operation as the preferred embodiment, but provides a fixed location for the wedge assembly 50*a*** in lieu of the more selectable location of the preferred embodiment.

A second alternative embodiment, as shown in FIG. 4, includes spherical wedge members **52*b* in wedge assembly 50*b*. The spherical wedge member 52*b* performs the same function as the wedge member 52 of the preferred embodiment, but the spherical wedge member 52*b* provides a diameter that varies non-linearly with the tension force applied by securing taps 65*b***.

An alternative one-piece wedge assembly **50*c*, consisting of wedge member 52*c*, shown in FIG. 5, is sized for insertion between the muffler exterior 42 and motor exterior 16 at the selected vertical loctaion. Wedge member 42***c* is preferably forced or cast in the shape of a conical frustum. As this is not an adjustable or tensionable wedge member, means must be provided for inserting the wedge member 52*c* in a forceable but non-damaging manner. Such means could consist of a hydraulic jack, a mechanical jack, or other similar devices. In this embodiment, the wedge member 52*c* is sized to provide the desired bias upon initial installation, and the preload thus established is not changeable thereafter.

Yet another alternative one-piece wedge assembly 50*d* is shown in FIGS. 6 and 7. FIG. 7 shows a cross-sectional view of the wedge member 52*d*. Wedge member 52*d* may be cast or forged of aluminum alloys, steel or similar material, however, machined aluminum barstock is preferred. Wedge member 52*d* includes a motor contacting surface 52*d*.2 and three muffler engaging surfaces 52*d*.4. The motor contacting surface 52*d*.2 is angled from the vertical approximately three degrees to provide point or line contact with the motor exterior 16, while each muffler engaging surface 52*d*.4 is at relative angles to the adjacent muffler engaging surface 52*d*.4 of approximately 25 degrees to provide at least three lines of contact with the muffler exterior 42.

Finally, another alternative embodiment of the one-piece wedge assembly 50*e*, shown in FIG. 8, is comprised of a motor engaging central portion 52*e*.6 with a muffler engaging projection portion 52*e*.8 formed at each end of the motor engaging central portion 52*e*.6. Each muffler engaging projection 52*e*.d extends from the central portion 52*e*.6 at an angle relative thereto of approximately 25 degrees to put the muffler engaging projections 52*e*.8 into contact with the muffler exterior 42 when the central portion 52*e*.6 is placed in contact with the motor exterior 16. Wedge member 52*e* is preferably a steel member formed in a punch press or similar die-tooled machine.

The angled portion, muffler engaging surface 52*d*.4 and muffler engaging surface 52*e*.8 also act to retain the respective wedge members 52*d* and 52*e* in the selected location and prevent dislocation due to stress or vibration.

Either of the foregoing wedge assembly embodiments, 50*d* or 50*e*, may be inserted into an assembled compressor system 10 in the same manner as the wedge assembly 50*c*. However, either wedge assembly 50*d* or 50*e* may also be installed in the compressor system 10 at the time of assembly. The amount of preload between the muffler 50 and the motor 15 is a function of the bias therebetween caused by the thickness t of either wedge member 52*d* or 52*e*.

In the preferred embodiment, wedge members 50 fabricated of aluminum alloys and steel alloys have been found to be satisfactory. Steel alloys being of stiffer material than aluminum alloys, provide a higher frequency shift, as the material stiffness of the wedge directly affects the amount of frequency shift, with stiffer material producing the higher frequency shift. Aluminum alloys are used in the preferred embodiment as being most cost effective. It is also feasible to use wedge members 50 fabricated of resilient material such as rubber and cork, although these are less effective for adjusting the compressor resonant frequency due to the lower material stiffness.

Wedge assembly 50 provides an inexpensive means for dampening the sound and reducing the perceived noise of a compressor system assembly 10 without the use of expensive, efficiency-reducing muffler systems, or additional insulation materials within a compressor system assembly 10. In addition, wedge assembly 50 is easily assembled during manufacture, and permits adjustment of the resonant frequency in a compressor system assembly 10 to a determined preselected resonant frequency while permitting substantial tolerance in the distance between the muffler exterior 42 and the motor exterior 16. It will be appreciated that wedge assembly 50 also contributes to the structural integrity of the compressor system 10. Although the wedge assembly 50 is a relatively simple assembly, it provides substantial advantages over the known prior art.

Modifications to the preferred embodiment of the subject invention will be apparent to those skilled in the art within the scope of the claims that follow hereinbelow.

I claim:

1. A gas compressor comprised of:

means for compressing a gas;

means for driving said compressing means, said drive means having an exterior portion thereof;

a muffler attached to said compressing means, said muffler having an exterior portion thereof in a generally spaced relationship to said exterior portion of said drive means; and means for mechanically linking said exterior portion of said drive means and said exterior portion of said muffler, said means disposed between said drive means and said muffler, and said linking means being adjustable to selectively determine a resonant frequency of said gas compressor when said drive means is operative.

2. The gas compressor as in claim 1 wherein the compression apparatus is further comprised of a containment shell heremetically enclosing said compressing means; and a means for mounting said compressing means within said containment shell in a retaining manner.

3. The gas compressor as in claim 1 wherein said mechanical linkage means comprises means for physically biasing said muffler with respect to said drive means.

4. The gas compressor as in claim 3 wherein said biasing means is comprised of a means for wedging between said drive means and said muffler, disposed between the exterior portion of said drive means and the exterior portion of said muffler.

5. The gas compressor as in claim 4 wherein said wedging means is fabricated of metal.

6. The gas compressor as in claim 4 wherein said wedging means is fabricated of resilient material.

7. A gas compressor having a structural resonant frequency in operation, comprised of:

a hermetically sealed shell;

a mounting structure enclosed within said shell;

means for compressing a gas mounted to said mounting structure, said gas compressing means having a drive motor operably connected thereto, said gas compressing means further including a muffler located in a generally spaced relationship with said motor; and means for adjustably mechanically linking an exterior portion of said motor and an exterior portion of said muffler such that said structural resonant frequency is adjusted to a selected, determined resonant frequency when said gas compressor is in operation.

8. A gas compressor having a structural resonant frequency in operation, comprised of:

a hermetically sealed shell;

a mounting structure enclosed within said shell;

means for compressing a gas mounted to said mounting structure, said gas compressing means having a drive motor operably connected thereto, said gas compressing means further including a muffler located in a generally spaced relationship with said motor; and means for mechanically linking an exterior portion of said motor and an exterior portion of said muffler such that said stuctural resonant frequency is adjusted to a selected, determined resonant frequency when said gas compressor is in operation, said means for mechanically linking further including wedging means for physically biasing said muffler with respect to said motor and means for retaining securing said wedging means between the exterior portion of said motor and the exterior portion of said muffler.

9. The gas compressor as in claim 8 wherein said wedge means is comprised of two wedge members and said means for securing is a securing member, each said wedge member retained upon a respective distal end of a securing member such that each said wedge member simultaneously engages the exterior portion of said motor and the exterior portion of said muffler.

10. The gas compressor as set forth in claim 9 wherein each said wedge is comprised of two generally parallel surfaces and a wedge surface defined by a frustum of a cone about an axis extending between said parallel surfaces.

11. The gas compressor as set forth in claim 9 wherein said wedge member is substantially spherical.

12. The gas compressor as set forth in claim 9 wherein said wedging means comprises a wedge fabricated from a metal.

13. The gas compressor as in claim 9 wherein said wedging means comprises a wedge fabricated from a resilient material.

14. The gas compressor as set forth in claim 9 wherein each said wedge member includes an opening for accepting said securing member.

15. The gas compressor as set forth in claim 14 wherein each said securing member is further comprised of an inflexible rod with thread means for retaining said wedge members upon respective distal ends of said rod.

16. A gas compressor having a structural resonant frequency in operation, comprised of:

a mounting structure;

means for compressing a gas mounted to said mounting structure, said gas compressing means including a motor secured thereto, said gas compression means further including a muffler located in a generally spaced relationship with said motor; and a one-piece wedge member for mechanically linking an exterior portion of said motor and an exterior portion of said muffler in a biasing, preload manner at a selected location such that said structural resonant frequency is adjusted to a selected, determined resonant frequency when said gas compressor is in operation.

17. The gas compressor as set forth in claim 16 wherein said wedge member is further comprised of a motor engaging central portion having a muffler engaging projection portion at two ends thereof, said wedge member having a thickness t between the motor engaging central portion and muffler engaging projection portions.

18. The gas compressor as set forth in claim 16 wherein said wedge member is further comprised of a motor contacting surface, a plurality of muffler engaging surfaces and a thickness t therebetween.

19. The wedge member as set forth in claim 18 wherein each said muffler engaging surface is angled relative to the adjacent said muffler engaging surface whereby said wedge member is retained in said selected location.

20. The method of altering a resonant frequency in a gas compressor including a motor and a muffler in a generally spaced relationship with respect to said motor, comprising the steps of;

mechanically linking adjustably said motor and said muffler;

adjusting said mechanical linkage so as to alter the resonant frequency of said gas compression apparatus to a predetermined resonant frequency when said compression apparatus is in operation.

21. The method as in claim 20 comprising the further step of engaging said motor and said muffler simultaneously with a plurality of wedge members with a securing member therebetween.

22. The method as in claim 20 wherein the step of adjusting said linkage is further comprised of physically biasing said motor with respect to said muffler by adjusting a means for wedging inserted between said motor and said muffler.

23. The method as in claim 22 comprising the further step of disposing said linkage means so as to increase the resonant frequency of said gas compression apparatus to a higher resonant frequency.

* * * * *